US007608149B2

(12) United States Patent
Nissinen et al.

(10) Patent No.: US 7,608,149 B2
(45) Date of Patent: Oct. 27, 2009

(54) NOZZLE

(75) Inventors: Vilho Nissinen, Numminen (FI); Mika Linjamäki, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 807 days.

(21) Appl. No.: 10/529,516

(22) PCT Filed: Sep. 26, 2003

(86) PCT No.: PCT/FI03/00702

§ 371 (c)(1),
(2), (4) Date: Oct. 17, 2005

(87) PCT Pub. No.: WO2004/028701

PCT Pub. Date: Apr. 8, 2004

(65) Prior Publication Data

US 2006/0147641 A1 Jul. 6, 2006

(30) Foreign Application Priority Data

Sep. 26, 2002 (FI) ..... 20021719

(51) Int. Cl.

| | |
|---|---|
| ***B05B 13/02*** | (2006.01) |
| ***B05B 7/06*** | (2006.01) |
| ***B05B 1/26*** | (2006.01) |
| ***B05B 1/06*** | (2006.01) |
| ***B05C 5/00*** | (2006.01) |

(52) U.S. Cl. ..... 118/325; 118/300; 118/313; 118/315; 239/544; 239/601

(58) Field of Classification Search ..... 118/313–315, 118/300, 325; 239/544, 566–568, 601; 347/47, 347/45, 40; 427/421.1, 427.1, 475, 424
See application file for complete search history.

(56) References Cited

U.S. PATENT DOCUMENTS

| | | | | |
|---|---|---|---|---|
| 3,843,055 | A | 10/1974 | Nord et al. | |
| 4,282,533 | A * | 8/1981 | Brooks et al. | 347/47 |
| 5,942,045 | A | 8/1999 | Raghavan et al. | |
| 6,063,449 | A | 5/2000 | Koskinen et al. | |
| 6,063,450 | A * | 5/2000 | Bernert et al. | 427/475 |

FOREIGN PATENT DOCUMENTS

| | | | |
|---|---|---|---|
| DE | 3339222 | A1 | 5/1985 |
| WO | WO 00/18514 | A1 | 4/2000 |
| WO | WO 03/060233 | A1 | 7/2003 |
| WO | WO 2004/028901 | A1 | 4/2004 |

OTHER PUBLICATIONS

International Search Report issued in PCT/FI2003/000702.

* cited by examiner

*Primary Examiner*—Yewebdar T Tadesse
(74) *Attorney, Agent, or Firm*—Stiennon & Stiennon

(57) ABSTRACT

A nozzle (1) for use in coating a web-like material by means of high-pressure spraying techniques is manufactured by forming a piece having a tapered duct ending in a closed tip, with a transverse V-shaped groove (3) subsequently machined in the tip. The angle of the V-shaped groove (3) is in the range from 25 to 50°, such as 35 to 45°.

20 Claims, 1 Drawing Sheet

NOZZLE

CROSS REFERENCES TO RELATED APPLICATIONS

This application is a U.S. national stage application of international app. No. PCT/FI2003/000702, filed Sep. 26, 2003, and claims priority on Finnish App. No. 20021719, filed Sep. 26, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to the coating of a moving web-like material using high-pressure techniques and it concerns the nozzle used in such coating. The invention can be used especially in paper coating.

In paper coating, a coating composition is applied to the paper surface with a special view to enhancing the printing characteristics of paper. Conventionally, presses, knife applicators and film-transfer devices have been used for coating. These techniques are difficult to implement reliably, especially when an increase in the running speed or coating of very thin paper is required.

Spray coating has appeared as the most recent coating technique. It has the special advantage of not requiring any mechanical coating means, such as an abrasive knife or rotating rod, in contact with the web. High-pressure spray techniques have proved particularly promising. Here the coating composition alone, without any gaseous medium, is driven under high pressure through a nozzle with small orifices, the composition being diffused (atomized) into small droplets. The pressure may be e.g. in the range from 1 to 200 MPa and the nozzle orifice area e.g. in the range from 0.02 to 0.5 $mm^2$. A typical maximum droplet size is approximately 100 μm. Such an apparatus comprises a nozzle array having one or more nozzle rows transverse to the path and consisting of a plurality of nozzles. The nozzles are disposed so as to cover the web as evenly as possible with the jets. Then jets formed by adjacent nozzles in a nozzle row overlap appropriately at their edges. The jet shape provided by the nozzle depends on the shape of the nozzle orifice. The usual aim is a fan-shaped jet, which is larger in the transverse direction than in the longitudinal direction of the web. Then the nozzle orifice is accordingly oval. To achieve regular coating, the fans are preferably disposed obliquely to the direction of travel of the web.

Spray coating of paper is described e.g. in the papers FI-B-108061 (corresponding to WO 9713036) and Nissinen V, OptiSpray, the New Low Impact Paper Coating Technology, OptiSpray Coating and Sizing Conference, Finland, Mar. 15, 2001.

Nozzles can be manufactured by making a piece of a suitable material, e.g. a highly wear-resistant material, the piece having a tapered duct ending in a closed tip, the desired nozzle orifice being subsequently machined in the tip. An oval orifice is provided if a transverse V-shaped groove is machined in the tip. The nozzle material may be e.g. a highly wear-resistant tungsten carbide composition (such as WC+Co).

SUMMARY OF THE INVENTION

The nozzle of this invention is for use in the coating of web-like material. The nozzle is made by machining in the closed tip of the tapered duct a transverse V-shaped groove at a machining angle in the range from 25 to 50°, such as 35 to 45°. The angle of the groove has an impact on the shape of the oval flow opening thus produced and hence on the shape of the jet produced. The nozzle of the invention provides a fairly rounded fan-shaped jet with soft edges, thus facilitating overlapping of adjacent jets so as to achieve optimally regular coating.

The flow duct is preferably circular in cross-section and straight. Before machining, the duct tip has preferably the shape of a spherical surface.

Enlargement of the V-shaped groove has proved to increase the wear resistance of the nozzle. In high-pressure spraying, flow rates are high (e.g. on the order of about 100 m/s), and coating compositions usually comprise solid substances (e.g. calcium carbonate), which substantially increase the wear of nozzles.

The nozzle may comprise a preliminary nozzle. It acts as a preliminary diffuser of the jet. The preliminary nozzle may especially comprise an expanding flow channel. It is particularly useful for enhancing the wear resistance of the nozzle. In a number of embodiments, the flow channel of the preliminary nozzle may expand or taper in the flow direction.

The size (diameter of orifice) of the preliminary nozzle may be e.g. in the range from 0.1 to 1 mm, typically in the range from 0.25 to 0.55 mm. The area of the preliminary nozzle orifice may account for e.g. at the most 50%, typically at the most 20% of the orifice area of the nozzle proper (secondary nozzle).

Also, a nozzle has now been invented, in which the ratio of the maximum diameter to the minimum diameter of the oval orifice is markedly more than 1, such as 1.2 to 3, especially 1.5 to 2.5. The nozzle orifice may have dimensions e.g. in the range from 1 to 0.3 mm×0.5 to 0.1 mm, typically 0.75 to 0.4 mm×0.35 to 0.15 mm.

Also, a nozzle has now been invented that comprises a secondary nozzle, a tapered flow duct and a preliminary nozzle connected in front of this, the area of the flow opening of the preliminary nozzle being at the most 1.1 times the transverse area of the flow opening of the secondary nozzle. Optimally, the area of the flow opening of the preliminary nozzle is at the most equal to the transverse area of the flow opening of the secondary nozzle. Such a preliminary nozzle allows for increased wear resistance of the preliminary nozzle.

The nozzles of the invention can be used in the coating of paper, such as printing paper and cardboard, for instance.

Some embodiments of the invention are described in detail below. The accompanying drawings pertain to the written description.

DESCRIPTION OF THE PREFERRED EMBODIMENTS

Figure 1:
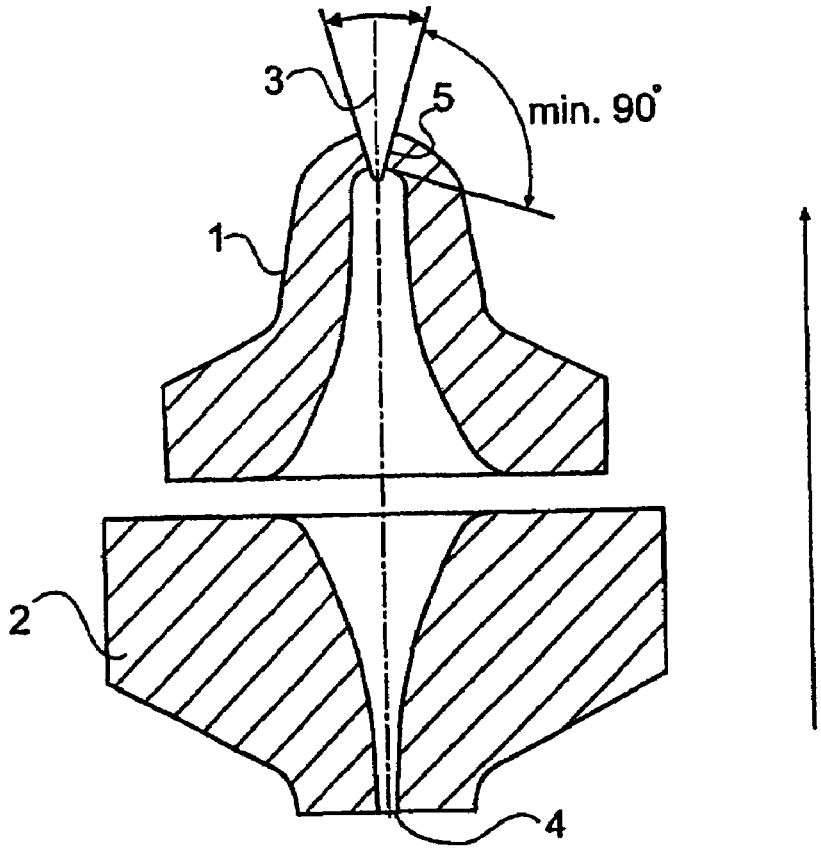
FIG. 1 shows a nozzle of the invention and a preliminary nozzle to be connected to the nozzle.

The nozzle of FIG. 1 comprises a secondary nozzle 1 and a preliminary nozzle 2.

The secondary nozzle 1 has been manufactured by first making a piece having a straight tapered flow duct, which is circular in cross-section and comprises a closed tip shaped as a spherical surface. In the center of the tip, a transverse V-shaped groove has been machined so as to provide a nozzle orifice 3 with the desired transverse area. The nozzle orifice 3 is oval and it produces a fan-shaped jet.

The preliminary nozzle 2 comprises an expanding flow duct, whose feed orifice 4 is circular.

The grinding angle of the nozzle orifice 3 influences the shape of the nozzle orifice and the jet obtained with this. The smaller the grinding angle, the flatter the shape and the sharper the edge of the fan-shaped jet produced. The fan edges may further comprise forwardly oriented profile peaks. An enlarged grinding angle will expand the oval shape of the flow cross-section, thus providing a jet profile which is rounder and better fitting with the profile of another jet.

In accordance with the invention, the grinding angle is in the range from 25 to 50°, such as 35 to 45°. Accordingly, the ratio of the major axis to the minor axis in the oval orifice is in the range from 1.2 to 3, such as 1.5 to 2.5. The fan angle of the jet thus produced is about 90°. The angle between ground surface and the surface of the flow duct is preferably at least 90°, typically from 100 to 150°.

At a coating station, there may be nozzles aligned in one single row at e.g. 60 mm intervals at a distance of about 100 mm from the web. The nozzles are preferably disposed overlapping at a suitable angle with a view to providing optimally regular double coverage.

It has also been found that the corner of the lower edge 5 of the grinding side is most critical in terms of wear. This corner is rounded during the wear of the nozzle, resulting both in a larger orifice area and altered orifice geometry and consequently also in a different jet shape. The originally oval orifice will approach a rectangular shape. The larger the grinding angle, the lower the abrasion.

Figure 2:
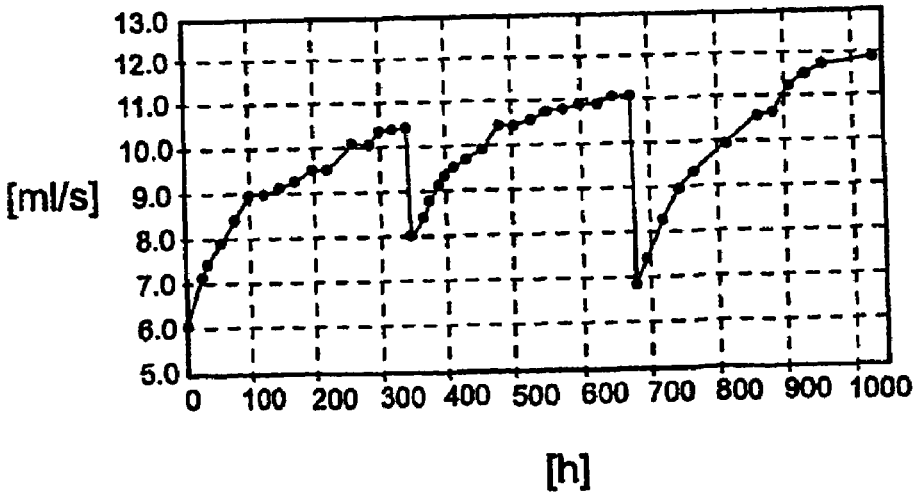
FIG. 2 shows the volume flow of the nozzle combination in FIG. 1 as a function of time.

The impact of abrasion was studied with regard to a nozzle of FIG. 1 by spraying calcium carbonate paste (50% dry matter content) under a pressure of 10 MPa. The volume flow (ml/s) as a function of time (h) is indicated in FIG. 2. The volume flow increases very strongly at the outset. However, at the end of about 95 hours, the growing rate is distinctly stabilized. At 336 hours, the preliminary nozzle was replaced, resulting in a 32% drop in the volume flow, which still was 34% higher than the starting level. Subsequently, the abrasion curve will be slightly gentler than that of two new nozzles. This is presumably due to the fact that a new preliminary nozzle has a smaller orifice than that of a worn secondary nozzle. As a preliminary nozzle has larger area of wear, the secondary nozzle will wear at a slower rate. As the abrasion curve stabilizes, the sizes of the nozzle orifice areas approach each other. As the secondary nozzle was replaced at 670 hours, the volume flow started to grow strongly again, thus supporting the assumption above.

When a preliminary nozzle of one size category below was fitted in the nozzle, abrasion became markedly slower. Over two weeks (336 h), the volume flow increased by 25% alone, and this can be readily compensated for with the aid of pumping pressure.

The area of the flow orifice of a preliminary nozzle should not be more than 1.1 times the transverse area of the flow orifice of the secondary nozzle. The area of the flow orifice of the preliminary nozzle is preferably at the most equal to the transverse area of the flow orifice of the secondary nozzle.

The invention claimed is:

1. An array of nozzles for use in coating by high-pressure spraying techniques a web of material moving in a first direction, the array of nozzles comprising:

at least one row of a plurality of secondary spray nozzles oriented transverse to the first direction;

wherein each secondary spray nozzle has portions defining a tapered duct, tapering to a closed tip in which a V-shaped groove has been machined, the V-shaped groove defining a secondary nozzle orifice defining a transverse nozzle orifice area, the secondary nozzle orifice arranged to form a jet of coating material; and wherein the V-shaped groove has a first side and a second side which intersect to define an angle which is between 25 to 50 degrees;

wherein each secondary spray nozzle is connected to a preliminary nozzle, and wherein the preliminary nozzle starts from a preliminary nozzle orifice which leads into an expanding duct, the expanding duct being connected to the tapered duct of the secondary spray nozzle so that a flow into the preliminary nozzle orifice leads into the expanding duct of the preliminary nozzle and then into the tapered duct of the secondary spray nozzle and then to the secondary nozzle orifice.

2. The array of nozzles of claim 1, in which the angle is between 35 to 45 degrees.

3. The array of nozzles of claim 1, wherein each secondary transverse nozzle orifice is oval in shape.

4. The array of nozzles of claim 1, wherein the secondary nozzle orifice defines a maximum diameter and a minimum diameter and a ratio between said maximum diameter and said minimum diameter which is greater than 1.2.

5. The array of nozzles of claim 4, wherein the ratio is between 1.2 and 3.

6. The array of nozzles of claim 5, wherein the ratio is between 1.5 and 2.5.

7. The array of nozzles of claim 1, wherein the secondary nozzle orifice has dimensions of between 1.0-0.3 mm by between 0.5-0.1 mm.

8. The array of nozzles of claim 7, wherein the secondary nozzle orifice has dimensions of between 0.75-0.4 mm by between 0.35-0.15 mm.

9. The array of nozzles of claim 1, wherein each preliminary nozzle orifice defines an orifice area which is at the most 1.1 times the transverse secondary nozzle orifice area to which the preliminary orifice is connected.

10. The array of nozzles of claim 9, wherein the orifice area of the preliminary nozzle orifice is at most equal to the secondary transverse nozzle orifice area.

11. The array of nozzles of claim 1, wherein the preliminary nozzle orifice has a diameter of between 0.1 mm and 1 mm.

12. The array of nozzles of claim 11, wherein the diameter of the preliminary nozzle orifice is between 0.25 and 0.55 mm.

13. The array of nozzles of claim 1, wherein the preliminary nozzle orifice has an area which is equal to or less than 50 percent of the secondary transverse nozzle orifice area.

14. The array of nozzles of claim 13, wherein each preliminary nozzle orifice has an area which is equal to or less than 20 percent of the secondary transverse nozzle orifice area.

15. The array of nozzles of claim 1 wherein the web of material is a paper web.

16. An array of nozzles with reduced wear characteristics for use in coating by high-pressure spraying techniques a moving web of paper or cardboard mounted for motion in a first direction, the array of nozzles comprising:

at least one row of a plurality of secondary spray nozzles which are arrayed transverse to the first direction;

wherein each secondary spray nozzle has portions defining a tapered duct which tapers to a tip which is closed but for portions of the nozzle forming a transverse V-shaped groove which intersects the tip, thereby defining a secondary nozzle orifice which defines a transverse nozzle orifice area, the secondary nozzle orifice arranged to form a jet of coating material; and wherein the V-shaped groove has a first side and a second side which intersect to define an angle which is between 25 to 50 degrees;

wherein each secondary spray nozzle is connected to a preliminary nozzle, so that the tapered duct of the secondary spray nozzle is in flow receiving relation to portions of the preliminary nozzle forming an expanding duct which starts from and is in flow receiving relation to portions of the preliminary nozzle forming a flow orifice, the flow orifice defining an area, the flow orifice in flow receiving relation to a supply of coating at a pressure between 1 MPa and 200 Mpa.

17. The array of nozzles of claim 16, wherein the secondary nozzle orifice defines a maximum diameter and a minimum diameter and a ratio between said maximum diameter and said minimum diameter which is greater than 1.2.

18. The array of nozzles of claim 16 wherein the preliminary nozzle flow orifice area is at the most 1.1 times the transverse area of the secondary nozzle orifice of the connected secondary spray nozzle.

19. The array of nozzles of claim 16 wherein the flow orifice of the preliminary nozzle has a diameter of between 0.1 mm and 1 mm.

20. The array of nozzles of claim 16 wherein the area of the flow orifice of the preliminary nozzle is equal to or less than 50 percent of the transverse area of the secondary nozzle orifice of the connected secondary nozzle.

* * * * *

UNITED STATES PATENT AND TRADEMARK OFFICE

CERTIFICATE OF CORRECTION

PATENT NO. : 7,608,149 B2
APPLICATION NO. : 10/529516
DATED : October 27, 2009
INVENTOR(S) : Nissinen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1045 days.

Signed and Sealed this

Twelfth Day of October, 2010

David J. Kappos

David J. Kappos
*Director of the United States Patent and Trademark Office*